US007207853B2

(12) United States Patent
Spencert et al.

(10) Patent No.: US 7,207,853 B2
(45) Date of Patent: Apr. 24, 2007

(54) METHOD AND APPARATUS OF INFORMATION SYSTEMS FOR ROWERS

(75) Inventors: Robert M Spencert, Redmond, WA (US); Timothy C Mickelson, Woodinville, WA (US)

(73) Assignee: Foresight Vision, LLC, Redmond, WA (US)

( * ) Notice: Subject to any disclaimer, the term of this patent is extended or adjusted under 35 U.S.C. 154(b) by 51 days.

(21) Appl. No.: 11/045,951

(22) Filed: Jan. 28, 2005

(65) Prior Publication Data

US 2005/0170711 A1 Aug. 4, 2005

Related U.S. Application Data

(60) Provisional application No. 60/540,379, filed on Jan. 29, 2004.

(51) Int. Cl.
*B63H 16/00* (2006.01)

(52) U.S. Cl. ..... 440/21

(58) Field of Classification Search ..... 440/21; 434/247

See application file for complete search history.

(56) References Cited

U.S. PATENT DOCUMENTS

| | | | | |
|---|---|---|---|---|
| 4,832,332 | A * | 5/1989 | Dumbser | 482/8 |
| 4,984,986 | A * | 1/1991 | Vohnout | 434/247 |
| 5,099,689 | A * | 3/1992 | McGinn | 73/379.01 |
| 6,980,118 | B2 * | 12/2005 | Buvac | 340/689 |
| 2005/0085348 | A1 * | 4/2005 | Kiefer et al. | 482/72 |

* cited by examiner

*Primary Examiner*—Jesús D. Sotelo
(74) *Attorney, Agent, or Firm*—Christensen O'Connor Johnson Kindness PLLC

(57) ABSTRACT

A system (12) for providing information to a rower of a boat (10). The system includes a display unit (32) adapted to be coupled to the boat for displaying information to the rower and an imaging device (36) in communication with the display unit. The imaging device is adapted to be coupled to the boat for capturing images and relaying the captured images to the display unit for display and viewing by the rower.

32 Claims, 5 Drawing Sheets

METHOD AND APPARATUS OF INFORMATION SYSTEMS FOR ROWERS

CROSS-REFERENCE TO RELATED APPLICATION

This application claims the benefit of U.S. Provisional Patent Application No. 60/540,379, filed Jan. 29, 2004, entitled Method and Apparatus of Information Systems for Rowers, the disclosure of which is hereby expressly incorporated by reference, and the filing date of which is hereby claimed under 35 U.S.C. § 119(e).

FIELD OF THE INVENTION

The present invention relates generally to information systems for rowers and more particularly, to information systems for rowers that provide vision and/or performance monitoring information.

BACKGROUND OF THE INVENTION

Rowing, as a competitive sport and for exercise, is a growing activity throughout the world. In all boats, the rower(s) sit facing the stem (rear) of the boat. In larger boats, there is a non-rowing participant who faces the bow (front) of the boat, and has some control over the path that the boat takes. In the great majority of boats, however, all the occupants are rowers, and at least one of the rowers is required to check over his or her shoulder regularly to maintain the course of the boat and to avoid other boaters and obstacles which may present themselves in the path of the boat. Each time a rower turns to look over his or her shoulder, there is an interruption in the rhythm of the rowing action which can result in disruption of the stability of the boat, cause an oar to catch on the water, and/or cause the course of the boat to be altered. Since there is not a person in the boat having continuous vision in the direction of travel, there is always a safety risk and collisions frequently happen with various objects, including other boats, obstacles in the water, etc. Thus, there exists a need for an information system that permits a rower of the boat to view the area in the path of travel of the boat without having to turn his or her head.

SUMMARY OF THE INVENTION

A system for providing information to a rower of a boat is disclosed. In one embodiment, the system includes an imaging device and a display unit adapted to be coupled to the boat for displaying information. The imaging device is also adapted to be coupled to the boat and is for capturing images and relaying the captured images to the display unit for display to the rower.

In another embodiment of the present invention, a system is provided that includes an imaging device and an interface for removably receiving a display unit adapted to display rowing information. The imaging device is adapted to be coupled to the boat and is for capturing images and relaying the captured images to the interface for transfer to the display unit for display when the display unit is received by the interface.

In yet another embodiment, a system is provided that includes a display unit for displaying information and an imaging device. The imaging device is used for capturing images and relaying the captured images to the display unit for display to the rower. The system further includes a motion system for determining at least one parameter descriptive of a motion of the boat and sending the determined parameter to the display unit for display. In addition, a sensor is included in communication with the display unit for sensing at least one parameter from a group consisting of a body function of the rower and a force applied by the rower upon an oar. The sensor is adapted to send data indicative of the sensed parameter to the display unit for display.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION

Figure 1:
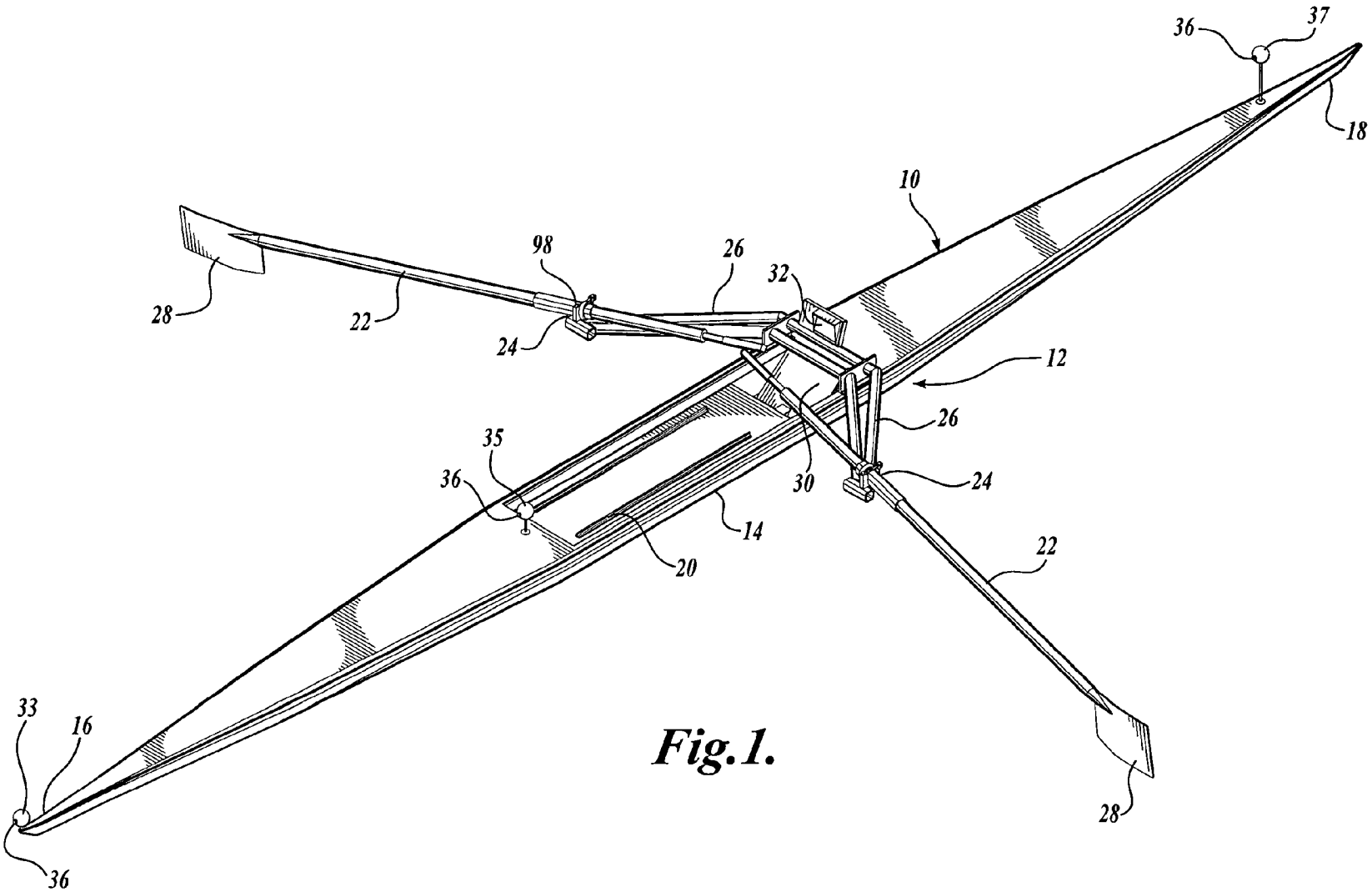
FIG. 1 is a perspective view of a typical rowing shell interfaced with a rowing information system formed in accordance with one embodiment of the present invention.

Referring to FIG. 1, a well known rowing shell 10 outfitted with one embodiment of an information system 12 formed in accordance with the present invention is shown. As will be described in more detail below, the information system 12 provides a rower (not shown) with information to aid in the operation of the rowing shell 10, such as images of an area in front of the rowing shell 10, speed, distance traveled, distance to a waypoint, stroke rate, stroke profile, navigational hazards, workout information, information regarding the rower's body functions, etc.

Focusing on the rowing shell 10, the rowing shell 10 is a well known lightweight, low freeboard vessel having an elongate midsection 14 extending between a pointed bow 16 and a pointed stern 18. The rower sits in the midsection 14 facing the stem 18 on a seat (not shown) that reciprocates upon a pair of slides 20. The rower grasps the ends of a pair of oars 22 and pulls forward while paddles 28 located at the distal ends of the oars 22 are disposed in the water propelling the rowing shell 10 in the direction of the bow 16. As the rower pulls on the oars 22, the rower extends his or her legs causing the seat to slide along the slides 20. The oars 22 pivot about a pair of oarlocks 24 coupled to an oarlock frame 26 as the rowing shell 10 moves forward. At the end of the stroke, the rower lifts the paddles 28 from the water and slides aft on the slides 20 in preparation to begin a second stroke of the oars 22. While rowing, the rower places his or her feet upon a foot stretcher 30.

While rowing, the rower views a display 32 of the information system 12. (Of note, for the purposes of this detailed description, since a coxswain is such an integral part of a rowing team, the term "rower" hereby includes a coxswain and the terms may be interchangeably used.) The display 32 is coupled to an imaging device 36 disposed within a bow enclosure 33, a midsection enclosure 35, and/or a stem enclosure 37. The imaging device 36 provides visual images to the display 32. In addition to showing the area before the rowing shell 10, the display 32 shows other data important to the rower, such as speed, distance traveled, distance to a waypoint, stroke rate, stroke profile, navigational hazards, workout information, information regarding the rower's body functions, etc.

Figure 2:
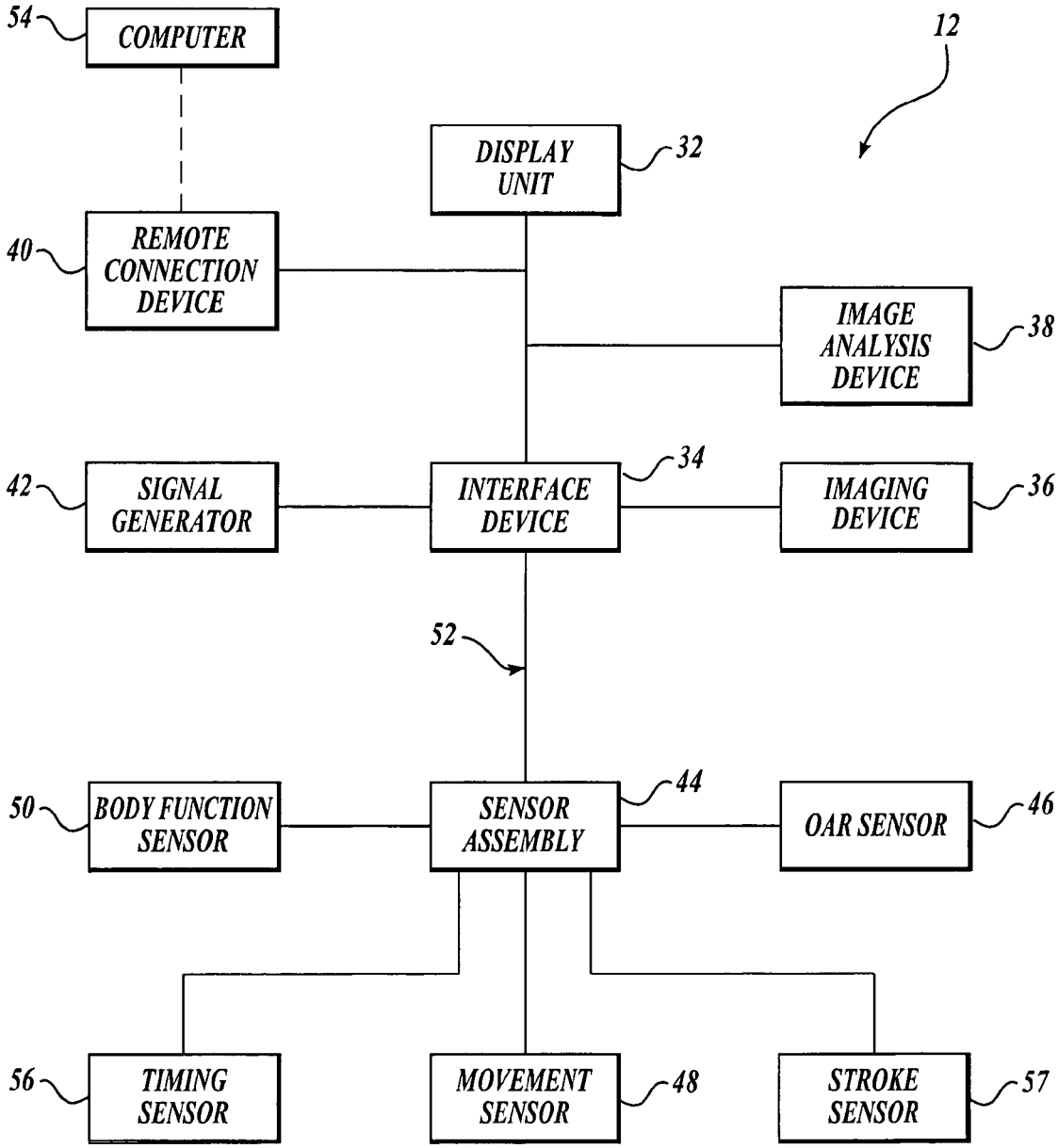
FIG. 2 is a schematic diagram of the information system shown in FIG. 1.

Turning to FIG. 2, the information system 12 will be described in more detail. The information system 12 includes the display 32, an interface device 34, an imaging device 36, an image analysis device 38, a remote connection device 40, a signal generator 42, and a sensor assembly 44. The sensor assembly 44 includes an oar sensor 46, a movement sensor 48, a body function sensor 50, a timing sensor 56, and a stroke sensor 57. The components of the information system 12 are coupled to one another by a data transfer system 52.

The display 32 may be any device suitable to display visual images obtained by the imaging device 36, one suitable example being an LCD type display of sufficient resolution to provide a recognizable image of the scene captured by the imaging device 36, and with a refresh rate capable of matching the transmission rate of the imaging device 36. In one embodiment, this functionality is provided by a well known portable computer, one suitable example being a portable computer of the type currently known as a personal digital assistant (PDA) that operates with specialized software to act as the viewing screen. This type of device is currently available with internal batteries, audible alarm generation capability, computer interface and other features that would support the features of this invention. Since the environment in which the display 32 operates is frequently wet, one embodiment would be water-resistant. In addition, the display 32 may be battery powered since there may not be another source of electrical power conveniently available on the rowing shell.

The illustrated embodiment is shown and described as a display 32 having a display screen and a computer processor for processing data housed together in a single unit. However, it should be apparent to those skilled in the art that alternate embodiments are within the spirit and scope of the present invention. For example, in another embodiment, the display 32 includes a display screen located remotely of the computer processor by a wired or wireless link.

Figure 3:
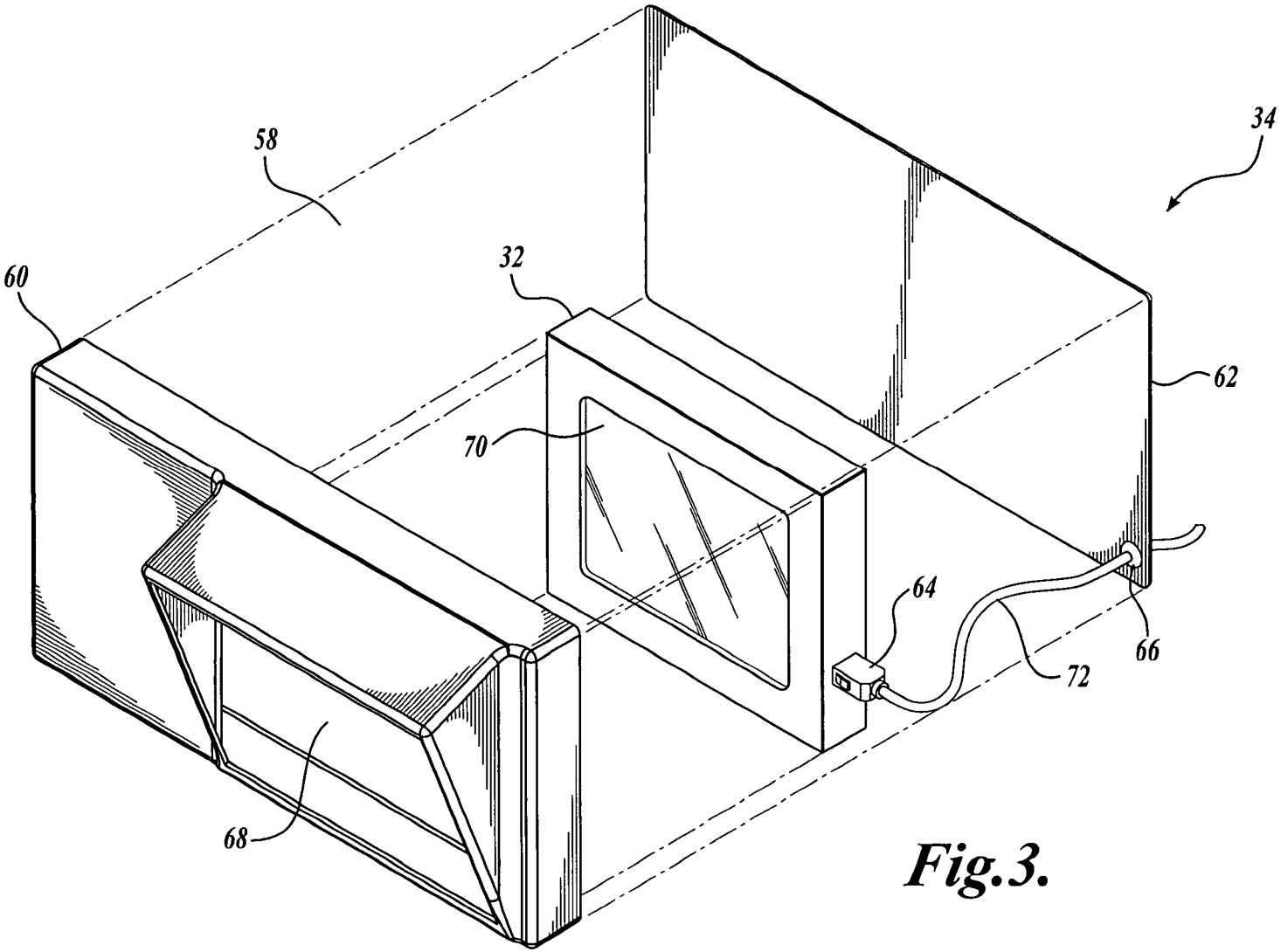
FIG. 3 is an exploded perspective view of a display and an interface device of the rowing information system shown in FIG. 1.

The display 32 may be housed in, and placed in communication with the other components of the information system 12 by the interface device 34. As shown in FIG. 3, the interface device 34 may include an enclosure 58 that protects the display 32 from damage, e.g., water damage. The enclosure 58 of the illustrated embodiment includes a front portion 60 that is preferably removably and sealingly coupled to a back panel 62, thereby protecting the display 32 which is removably stored therein. The front portion 60 includes a viewing window 68 permitting a user to view a display screen 70 of the display 32 when disposed in the enclosure 58. The interface device 34 further includes a connector 64 for coupling the other components of the information system 12 in communication with the display 32 via the data transfer system 52. Cabling 72 connected to the connector 64 passes through the enclosure 58 through a watertight seal 66. The interface device 34 of the illustrated embodiment permits the display 32 to be removably coupled to the other components of the information system such that a user may place the display 32 in the enclosure 58 while rowing and then remove the display 32 when done rowing such that the display 32 may be used for other purposes or taken to a remote location for the download of data.

Returning to FIG. 2, the data transfer system 52 links the various components of the information system 12 in communication with one another. The data transfer system 52 may be any suitable system for permitting the transfer of data, a few suitable examples being cabling, such as the cabling 72 shown in FIG. 3, or wireless data links.

The data transfer system 52 may also link the display unit 32 to the imaging device 36. The imaging device 36 may be any suitable device capable of capturing visual images of the area surrounding the rowing shell. In the illustrated embodiment, the imaging device 36 is a well-known small, electronic camera for providing still or video images. The camera can be equipped with lens systems to allow a variety of visual apertures for the image acquired by the camera. In one embodiment, the camera would utilize a lens system offering a viewing aperture of 45 to 100 degrees and capture images in the visible spectrum. The camera may also incorporate a lens system that can capture images in the infrared spectrum. In one embodiment, the camera provides images collected by illuminating the scene with energy and capturing the energy reflected back from the objects in the viewing aperture as an image. The rower may desire to operate the boat in low light conditions, and thus the imaging device 36 of the illustrated embodiment is able to provide a usable image under low light conditions, for instance, by using well-known night vision imaging techniques.

In one embodiment of the present invention, the electronic signals representing the images captured by the camera are automatically transmitted to the display 32. The preferred frequency of image transmission is sufficient to obviate the need for any rower to turn to look over his or her shoulder at intervals to verify course and avoid collisions. In one embodiment, the images are transmitted at a rate of 3 to 60 images per second. Although a specific images transmission rate is disclosed, it should be apparent to those skilled in the art that the images provided by the imaging device may be provided at any number of rates to the display, a few suitable examples being at lower refresh rates wherein the images appear as still images updated on a periodic basis or at a high refresh rate wherein the images appear as video images.

In another embodiment of the present invention, the display 32 mirrors the image captured by and received from the imaging device. A frequent confusion caused by facing backwards in the boat is confusing which oar to pull in order to cause a selected correction in the course. Accordingly, displaying a mirror image, i.e., swapping right for left, helps limit the confusion in the rowers. Therefore, in the illustrated embodiment, the ability to allow the user to select either a correct or mirrored image is provided.

Referring to FIG. 1, the imaging device 36 may be placed in any number of locations on the rowing shell 12. Each rowing shell 10 used in competitive rowing, and most boats used for exercise rowing, are equipped with a small spherical object mounted at the bow of the boat that is used to judge the order of finish of the boats, among other applications. This device is called the bow ball. Accordingly, the imaging device 36 may be placed on the bow 16 of the rowing shell 10 in a bow ball 33. The bow ball 33 is an enclosure that may be the regulation color, size, and shape of a well-known bow ball. The imaging device 36 may be placed in the bow ball in such a manner that the imaging device 36 is adapted to provide for easy alignment and fixation of the camera. The imaging device 36 may alternately be located upon the midsection of the rowing shell 10, within a midsection enclosure 35.

The imaging device 36 may alternately be located upon the stern 18 of the rowing shell 10 within a stern enclosure 37. Placing the imaging device 36 upon the stern 18 permits the rower or rowers to see themselves rowing along with the area surrounding the rowing shell 10. This provides the benefit of the rower being able to visually analyze his or her stroke technique while rowing in addition to providing a perspective to the area surrounding the rowing shell 10 shown on the display 32. Moreover, the elevated mounting location near the stem 18 of the boat looking forward allows all rowers to see more easily how their stroke and technique is synchronized with their fellow rowers for multi rower rowing shells, or for an individual to see aspects of their stroke which would not be apparent from feel.

Although the above description described the imaging device as being mounted to the rowing shell 10, it should be apparent to those skilled in the art that the imaging device 36 may be mounted in other locations, such as upon the user. For instance, the imaging device 36 may be worn upon the head of the user and oriented in the direction of travel to provide images of the area before the rowing shell. The user may then turn their head as desired to adjust the orientation of the imaging device 36. Further, although the imaging device 36 is described and depicted as being mounted in a few specific locations, it should be apparent that the imaging device may be mounted in other locations and orientations without departing from the spirit and scope of the present invention. For instance, the imaging device 36 may be mounted to view the area surrounding the sides of the boat or aft of the boat. For instance, the imaging device 36 may be mounted near the bow of the boat in an elevated position facing aft to offer a different view of the rower or rowers for aid in training without offering the view of the area forward of the boat.

Since the environment in which the imaging device 36 operates is frequently wet, in one embodiment, the imaging device 36 would be water-resistant. In addition, the imaging device 32 may also be battery powered, such as by the battery of the display 32, since there may be no other source of electrical power conveniently available on the rowing shell 10.

Turning to FIG. 2, an image analysis device 38 may also be coupled in communication with the imaging device 36. The image analysis device 38 includes software analysis tools to analyze the images from the imaging device 36 and identify and mark objects of specific interest to the rower in the presented image. For instance, objects floating on the water's surface, such as debris which could damage the shell if hit, or course markers which may identify distance traveled or turning points in a race, can be of significant importance to the rower but may be too small or difficult to identify for the rower. Being able to highlight objects of this sort increases the value of the vision system to the rower. The objects may be highlighted by displaying them in a certain color, for instance red or a fluorescent color.

The information system 12 may also include a remote connection device 40. The remote connection device 40 permits the information system 12 to be linked to a computer 54 or display located remotely of the rowing shell. For instance, the remote connection device 40 may permit the information system 12 to be linked wirelessly with a computer 54 having a display that is located in a coach boat located in the vicinity of the rowing shell, thereby providing a coach in the coach boat with the same data displayed on the display 32 located in the rowing shell. Further, the coach may be able to send data to the information system 12 located on the rowing shell, providing instructions or workout data. Alternately, the remote connection device 40, by wireless or hard wired means, may be used to couple the information system 12 in communication with a remotely located computer 54 for download or uploading of data, such as to upload or download workout data for further analysis or archiving. Further still, the remote connection device 40 may transfer audio data between the information system 12 and the computer 54 or display located remotely of the rowing shell. For instance, the information system 12 and the computer 54 or display located remotely of the rowing shell may each include audio devices, such as speakers and/or microphones, wherein the remote connection device 40 links the audio devices in communication with each other such that the rowers may communicate with a user located remotely of the rowing shell, such as a coach in the coach boat.

The information system 12 may include specialized software operating on a computer system 54 positioned remotely from the rowing shell. The performance information collected during periods of exercise can be stored, analyzed, and reviewed on the separate computer system 54 and comparative performance analysis can be used to plan future training sessions, highlight needed technique changes for the rower, coordinate the technique of the members of a team, match team members for optimal technique or other data storage and analysis techniques.

The information system 12 may also include a signal generator 42. The signal generator 42 is able to provide signals, such as audio, visual, or physical (such as vibrations, especially for visual and/or hearing-impaired users), to indicate to users certain conditions. For instance, the signal generator 42 may generate cadence signals to provide a timing stimulus to assist in maintaining a particular rowing cadence or an alarm signal to indicate when the rowing cadence exceeds or falls below a predetermined cadence or range of cadences. The signal generator 42 may provide a signal that warns the rower of a possible collision with objects or proximity to a course mark or other waypoint. The signal generator 42 may also issue a signal when a monitored body function of the rower exceeds or falls below a predetermined parameter, one suitable example being when a heart rate of the rower exceeds a selected rate, such as 140 beats per minute.

The information system 12 may include a sensor assembly 44. The sensor assembly 44 of the illustrated embodiment is adapted to sense movement of the rowing shell 10, along with body functions of the rowers, including the forces applied by the rower to the oar or oars, timing data, and stroke information. To accomplish these functions, the sensor assembly 44 includes an oar sensor 46, a movement sensor 48, a body function sensor 50, a timing sensor 56, and a stroke sensor 57.

Figure 4:
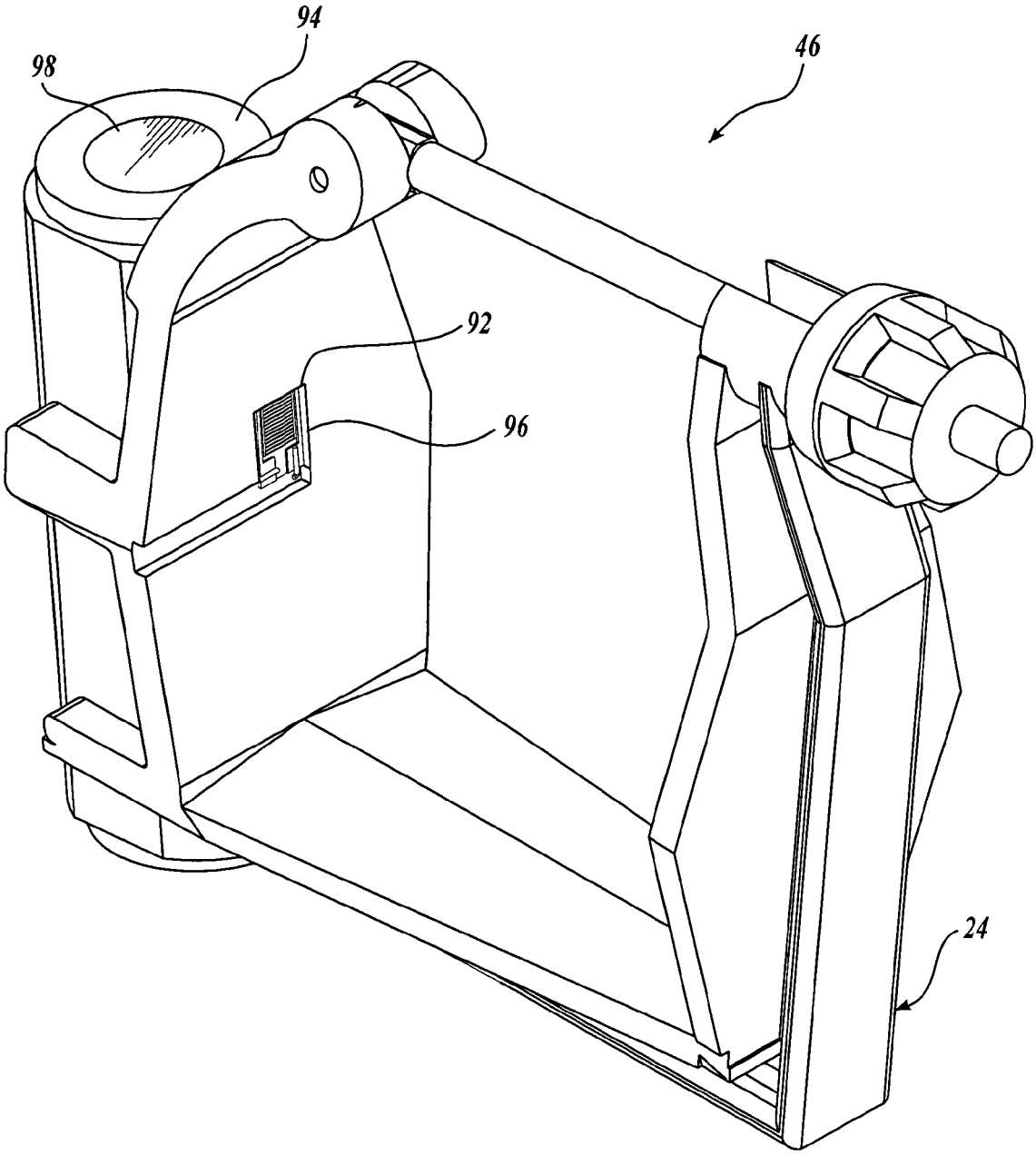
FIG. 4 is a perspective view of an oarlock and an oar sensor of the rowing information system shown in FIG. 1.

As shown in FIG. 4, the oar sensor 46 is interfaced with a well known oarlock 24, such as an oarlock manufactured by CONCEPT 2, having a place of business at 105 Industrial Park Drive, Morrisville, Vt. 05661-8532, part number PN401 or PN402, which has been modified to incorporate a force sensor 92. The force sensor 92 in the oarlock 24 allows the capture and presentation of data on force generated by the rower such that a meaningful curve of the rower's efficiency in propelling the rowing shell on each stroke can be displayed. This information is advantageous to rowers for improving their rowing technique.

The force sensor 92 in the illustrated embodiment is a strain gauge used for measuring a strain in a bearing 94 of the oarlock 24 caused by a force of the oar upon the oarlock 24 during a stroke. The force of the oar creates a resistance change in the strain gauge of the force sensor 92. In the illustrated embodiment, the strain gauge is a standard Wheatstone bridge with a battery and wireless or hardwired transmitter mounted to the back of the oarlock bearing 94.

The force sensor 92 is preferably firmly bonded to the oarlock 24, and is placed in a recess 96 in the oarlock so that the bearing 94 of the oarlock 24 does not contact the force sensor 92 or wiring associated with the oar sensor 46 when the oar is being feathered. The strain gauge of the force sensor 92 measures the deflection in the oarlock 24 as the force exerted by the rower is transferred to the blade of the oar with the oarlock 24 being used as a fulcrum. Moreover, a pin 98 of the oarlock frame 26 (See FIG. 1) is received by the bearing 94. The pin 98 and a body of the oarlock 24 will deflect in a linear and elastic fashion as a function of the force applied by the oar during stroke. The strain gauge measures this deflection to determine the force applied by the rower upon the oar and transferring data indicative of the sensed force to the display unit for display.

Turning to FIG. 2, as opposed to the force sensor, the movement sensor 48 is adapted to analyze movement of the rowing shell. In one embodiment, the movement sensor 48 is a positioning system, such as a well-known Global Positioning Satellite (GPS) system that is able to identify the location of the rowing shell upon the earth. The movement sensor 48, using a GPS unit, is able to provide position and course mapping information upon the display 32. The desired course can be programmed and displayed on the display 32 as an overlay to the visual scene presented by the imaging device 36. The signal generator 42 may be used to issue an alarm signal when the rowing shell is off course. The GPS data can also be used to provide specific instantaneous velocity information. The GPS data can be kept in memory to provide distance and rate information for segments of an outing or the entire trip. It is also foreseen that this data could be downloaded to an external recording and calculating device, which could then offer performance records and training effectiveness measures. The GPS data can be used to determine and display stroke efficiency, to reinforce good technique, or highlight technical flaws in a stroke.

Although the illustrated movement sensor 48 is described as using a GPS unit to determine boat movement data, it should be apparent to those skilled in the art that the movement sensor 48 may include or utilize other devices, a few suitable examples being well known accelerometers and in water sensors, for determining boat movement data.

The sensor assembly 44 also includes the body function sensor 50. The body function sensor 50 is able to monitor one or more body functions of the rower. For instance, the body function sensor 50 may be a heart rate sensor for monitoring a heart rate of the user, a body temperature sensor for monitoring a body temperature of the user, a $VO_2$ sensor for monitoring a $VO_2$ of the user, an EKG sensor for measuring the EKG signals of the user, a pulse oximetry sensor for measuring a percentage of hemoglobin (Hb) which is saturated with oxygen, blood flow values, etc., of the user. The monitoring can be performed by the body function sensor 50, typically coupled to the user, and the information displayed on the display 32 for rower viewing. The body function sensor 50 may be in communication with the signal generator 42 such that if the body function monitored exceeds or falls below a predetermined value or range of values, an alarm signal will be issued.

Finally, it will be appreciated that the sensor assembly 44 may also include less, more, or other sensors or calculators without departing from the spirit and scope of the present invention. One suitable example is a timing sensor 56 for performing timing functions such as clock, stopwatch, lap counters, lap splits, etc. This information may be transferred to the display unit 32 for viewing by the rower. Alternately, the timing sensor 56 may be incorporated in other components of the information system 12, such as within or integrally formed with the display unit 32 itself, or within or integrally formed with a GPS unit used as the movement sensor 48.

An additional example is a stroke sensor 57. The stroke sensor 57 is adapted to count the number of times an oar is stroked or determine when an oar is stroked and relay this information to the display unit 32. In one embodiment, the stroke sensor 57 is a sensor mounted in proximity to the seat rails 20 (See FIG. 1) of the rowing shell and is able to determine when a stroke occurs or determine a rate at which strokes are being made by monitoring seat movement. The stroke sensor 57 is also adapted to send data indicative of this information to the display unit 32 for display to the rower. The stroke sensor 57 may have a timing device associated with the stroke sensor 57 itself to determine a stroke rate, or alternately, the display unit 32 may use the stroke data obtained from the stroke sensor 57 along with time data obtained from the timing sensor 56 to obtain a stroke rate. The stroke sensor 57 may alternately sense the movement of the oars themselves to determine the occurrence of a stroke, or may alternately determine the occurrence of a stroke from data obtained from the oar sensor 46.

Another example is a weather sensor, for measuring weather conditions such as wind speed and direction, air temperature, sea temperature, humidity, barometer, etc. Still another example is a radar sensor for broadcasting and receiving radar signals for detecting the presence of other vessels and displaying the location of the other vessels detected on the display.

Figure 5:
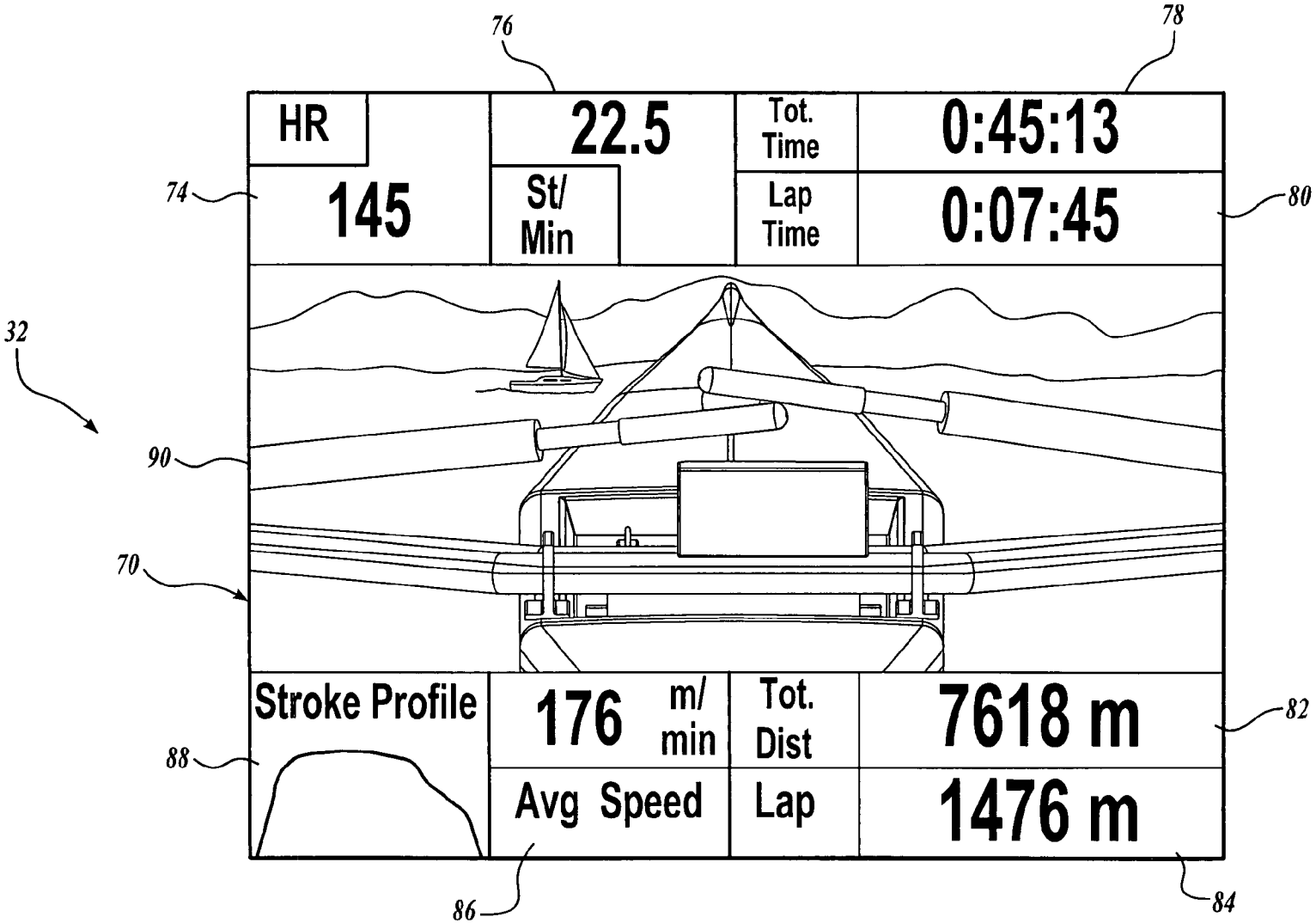
FIG. 5 is a screen shot of the display shown in FIG. 3.

Now that the imaging device 36 and sensor assembly 44 have been described, the display 32, which displays the images and information captured by these devices, will be described in more detail. Referring to FIG. 5, the display screen 70 of display 32 is shown during typical operation. The display screen 70 includes various sections for display information useful to a rower. For instance, the display screen 70 may include a body function section 74 for displaying data indicative of a body function of a rower as sensed by the body function sensor 50. In the illustrated embodiment, the body function section 74 displaces a heart rate of the rower as sensed by the body function sensor 50, however, the body function section 74 may alternately display one or more other indicators of the rowers body functions, a few suitable examples being body temperature, $VO_2$, EKG, percentage of hemoglobin (Hb) which is saturated with oxygen, blood flow values, etc.

The display screen 70 may also include a timing section 78 and 80, wherein timing data obtained from the time sensor 56 is displayed. In the illustrated embodiment, the timing section 78 and 80 may be subdivided into a total time section 78 in which a total time since a timer was begun is displayed and a lap time section 80 wherein an amount of time since the start of a lap is shown.

The display screen 70 may also include a stroke rate section 76 wherein the number of strokes effected by the rower within an increment of time is displayed. In the illustrated embodiment, the stroke rate section is showing strokes per minute, but stroke efficiency in meters per stroke could also be displayed as well as information about the percentage of the stroke spent in driving the boat forward. All three measures have importance to the rowers in terms of improving efficiency.

The display screen 70 may also include a distance section 82 and 84, wherein distance data obtained from the movement sensor 48 is displayed. In the illustrated embodiment, the distance section 82 and 84 may be subdivided into a total distance section 82 in which a total distance traveled since a start time began is displayed and a lap distance section 84 wherein a distance traveled since the start of a lap is shown.

The display screen 70 may further include a speed section 86, wherein speed data obtained from the movement sensor 48 is displayed. In the illustrated embodiment, the speed section 86 displays speed information such as average speed as shown, or other speed data, a few suitable examples being peak speed, current speed, average lap speed, estimated time for a preset distance, etc.

The display screen 70 may further include a stroke profile section 88. The stroke profile section 88 displays information regarding a force applied upon an oar(s) during the stroke as obtained by the oar sensor 46. In other words, the stroke profile section 88 displays the force per time applied by the rower to the oar during a stroke. An ideal stroke profile may be superimposed over the actual stroke profile to aid a rower in correcting their stroke technique.

The display screen 70 may additionally include an image section 90. The image section 90 is adapted to display images obtained by the imaging device 36 for viewing by the user. Of note, the image section 90 of FIG. 5 is depicted with a captured image showing the rowing shell and the area surrounding the rowing shell as seen from an imaging device located on a stem of the rowing shell. For the purpose of clarity, the rower is not shown and the rowing shell is shown at an exaggerated incline, with a bow of the rowing shell shown raised above the water to better show the components of the rowing shell and information system.

Although the illustrated and described display screen 70 includes a plurality of sections for displaying information useful to a rower, it should be apparent to those skilled in the art that illustrated and described display screen 70 is representative in nature, and display screens 70 having any combination of the sections described above or additional sections for displaying additional information not specifically described herein are also suitable for use and are within the spirit and scope of the present invention.

Referring to FIG. 2, the information system 12 may be used to lead a user through a predetermined workout. The predetermined workout may include rowing for a specific distance, time, stroke rate, calories burned, number of strokes made, specific number of strokes having a preselected force profile (such as an exemplary force profile), a preselected duration in which a specific monitored body function (such as heart rate, VO2, etc.) is within a preselected range, until a predetermined waypoint is reached, until a selected speed is reached or maintained for a selected period, or combination thereof for a single interval, or multiple intervals. The user may select the workout from a set of predetermined workouts, such as a set of default workouts which come saved on the display unit 32, a set of previous workouts saved on the display unit 32, or custom workouts created on the display unit 32 itself or downloaded to the display unit 32 from a remote source, such as the remote computer 54 or via the internet. The display unit 32 may include controls for controlling the workout being displayed on the display unit 32, a few suitable examples of the controls including controls able to start, stop, and pause the workout.

The signal generator 42 of the illustrated embodiment is adapted to emit audio, visual, or physical signals indicating to a user their performance relative to the preplanned workout being played by the display unit 32. For instance, in a preferred embodiment, the signal generator 42, or other device, is able to give an audio, visual, or physical signal indicating if the user needs to adjust his or her workout to place it in conformance with the preplanned workout. For instance, the signal generator 42 can issue a signal indicating to the user that they need to increase or decrease a stroke rate, force applied to the oar, speed, heart rate, etc. to match the preplanned workout. Alternately, the signal generator 42 may indicate how much of the workout is left or time until a change in the workout is to occur.

Although the illustrated embodiment is described as a system for a rowing shell of a single rower, it should be apparent to those skilled in the art that the information system 12 may be expanded to accommodate rowing shells designed for multiple rowers. In one alternate embodiment, multiple displays are used for displaying, in real time, the images from the imaging device, and other desirable information, meeting the environmental, weight and power requirements of the application, the display positioned so that it is easily viewable for the rowers. In a rowing shell, there are typically from 1 to 8 rowers and a coxswain. In one embodiment formed in accordance with the present invention, all the occupants of the boat have an individual display positioned for their easy viewing. Alternatively, multiple rowers may utilize a single display screen, or as few as one rower or a coxswain may use the display screen to guide the boat and prevent collisions. In such an embodiment, the display may be mounted on the foot stretcher of the rower.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A system for providing information to a rower of a boat comprising:

(a) a display unit adapted to be coupled to the boat for displaying information to the rower; and (b) an imaging device in communication with the display unit, wherein the imaging device is adapted to be coupled to the boat for capturing images of an area surrounding the boat and relaying the captured images of the area surrounding the boat to the display unit for display to the rower.

2. The system of claim 1, further comprising at least one sensor in communication with the display unit for sensing a force applied by the rower upon an oar and transferring data indicative of the sensed force to the display unit for display.

3. The system of claim 1, further comprising at least one sensor in communication with the display unit and adapted to be coupled to the rower for sensing at least one body function of the rower.

4. The system of claim 3, wherein the sensor is a pulse oximetry sensor.

5. The system of claim 1, further comprising a motion system in communication with the display unit, the motion system adapted to sense motion of the boat.

6. The system of claim 5, wherein the motion system includes a global positioning system for sensing a position of the boat.

7. The system of claim 5, wherein the motion system includes an accelerometer for sensing movement of the boat.

8. The system of claim 1, further comprising an interface device adapted to removably receive the display unit.

9. The system of claim 8, wherein the display unit is a portable computer.

10. The system of claim 1, further comprising a signal generator in communication with the display unit, the signal generator adapted to emit a signal to aid the rower in maintaining a selected stroke rate.

11. The system of claim 1, further comprising a signal generator in communication with the display unit, the signal generator adapted to emit a signal to warn the rower of a perceived navigational danger.

12. The system of claim 1, wherein the display unit is adapted to selectively display a mirror image of the captured images.

13. The system of claim 1, further comprising an image analysis unit, the image analysis unit adapted to evaluate the captured images for selected objects.

14. The system of claim 13, wherein the image analysis unit is adapted to highlight the selected objects upon the captured images when displayed upon the display unit.

15. The system of claim 1, wherein the imaging device is adapted to be located within a bow ball located at a bow of the boat.

16. The system of claim 1, wherein the imaging device is adapted to be coupled to the boat forward of the rower so as to capture a bow of the boat in the captured images.

17. The system of claim 1, wherein the imaging device is located in proximity of a stern of the boat such that the captured images may include the rower and the boat.

18. The system of claim 1, further including a communications link between the display unit and a remote computer.

19. The system of claim 1, further comprising a communications link adapted to communicatively couple the display unit with a remote computer.

20. A system for providing information to a rower of a boat comprising:

(a) an interface for removably receiving a display unit adapted to display rowing information; and (b) an imaging device adapted to be communicatively coupled to the display unit for capturing images of an environment surrounding the rower and relaying the captured images to the display unit for display.

21. The system of claim 20, further comprising at least one sensor adapted to be communicatively coupled to the display unit and adapted to sense a force applied by the rower upon an oar.

22. The system of claim 20, further comprising at least one sensor adapted to be communicatively coupled to the display unit and adapted to be coupled to the rower for sensing at least one body function of the rower.

23. The system of claim 20, further comprising a location system adapted to be communicatively coupled to the display unit and adapted to sense a location of the boat.

24. The system of claim 20, wherein the interface is adapted to removably receive a portable computer.

25. The system of claim 20, further comprising a signal generator adapted to be communicatively coupled to the display unit, the signal generator adapted to emit a signal to aid the rower in maintaining a selected stroke rate or to warn the rower of a perceived navigational danger.

26. The system of claim 20, further comprising a communications link adapted to communicatively couple the display unit with a remote computer.

27. The system of claim 20, further comprising a movement sensor adapted to be communicatively coupled to the display unit and adapted to sense the motion of the boat in water.

28. A system for providing information to a rower of a boat comprising:

(a) a display unit for displaying information;

(b) an imaging device for capturing images of an area surrounding the boat and sending the captured images to the display unit for display to the rower;

(c) a motion system for determining at least one parameter descriptive of a motion of the boat and sending the determined parameter to the display unit for display to the rower; and (d) a sensor for sensing at least one parameter from a group consisting of a body function of the rower and a force applied by the rower upon an oar, and sending data indicative of the sensed parameter to the display unit for display.

29. The system of claim 28, further comprising a communications link adapted to communicatively couple the display unit with a remote computer.

30. A system for providing information to a rower of a boat comprising:

(a) a display unit for displaying information to the rower;

(b) an imaging device for capturing images of an area surrounding the boat and sending the captured images to the display unit for display to the rower; and (c) a global positioning system in communication with the display unit.

31. The system of claim 30, wherein the global positioning system is for determining at least one parameter descriptive of the location of the boat and sending the determined parameter to the display unit.

32. The system of claim 30, wherein the global positioning system is for determining at least one parameter descriptive of the movement of the boat and sending the parameter to the display unit.

* * * * *

UNITED STATES PATENT AND TRADEMARK OFFICE

CERTIFICATE OF CORRECTION

PATENT NO. : 7,207,853 B2
APPLICATION NO. : 11/045951
DATED : April 24, 2007
INVENTOR(S) : R.M. Spencer et al.

It is certified that error appears in the above-identified patent and that said Letters Patent is hereby corrected as shown below:

| COLUMN | LINE | |
|---|---|---|
| Title page item (12) Pg. 1, col. 1 | Inventor | "**Spencert et al.**" should read **--Spencer et al.--** |
| Title page item (75) Pg. 1, col. 1 | Inventors | "**Robert M Spencert,**" should read **--Robert M. Spencer,--** |
| Title page, item (75) Pg. 1, col. 1 | Inventors | "**Timothy C Mickelson,**" should read **--Timothy C. Mickelson,--** |

Signed and Sealed this

Seventh Day of August, 2007

JON W. DUDAS
*Director of the United States Patent and Trademark Office*